US007507149B1

(12) United States Patent
Douglas

(10) Patent No.: US 7,507,149 B1
(45) Date of Patent: Mar. 24, 2009

(54) DRILL BIT DRESSER

(76) Inventor: Lawrence M. Douglas, 8 Candleberry Ct., Bourne, MA (US) 02532-8334

( * ) Notice: Subject to any disclaimer, the term of this patent is extended or adjusted under 35 U.S.C. 154(b) by 0 days.

(21) Appl. No.: 12/074,767

(22) Filed: Mar. 6, 2008

Related U.S. Application Data

(60) Provisional application No. 60/966,247, filed on Aug. 27, 2007, provisional application No. 60/961,551, filed on Jul. 23, 2007, provisional application No. 60/905,088, filed on Mar. 6, 2007.

(51) Int. Cl.
*B24B 1/00* (2006.01)
*B24B 3/24* (2006.01)

(52) U.S. Cl. ..... 451/321; 451/48; 451/523

(58) Field of Classification Search ..... 451/47, 451/48, 321, 322, 523; 76/102, 108.1, 108.2, 76/108.4, 108.6; 408/18; 409/66
See application file for complete search history.

(56) References Cited

U.S. PATENT DOCUMENTS 682,565 A 9/1901 Ovens
820,023 A 5/1906 Spreyer
1,197,846 A 9/1916 Olive
1,231,258 A 6/1917 Horvath
1,349,169 A 8/1920 Scheib
1,510,726 A 10/1924 Watson
1,788,682 A 1/1931 Mitchell
2,369,642 A 2/1945 Benning
2,394,839 A 2/1946 Bowman
2,689,491 A 9/1954 Bredesen
2,800,755 A * 7/1957 Perra ..... 451/415
3,172,242 A 3/1965 Wood
3,197,924 A 8/1965 Mirchell
3,382,738 A 5/1968 Copeland
3,388,503 A 6/1968 Uberti
3,599,302 A 8/1971 Dudek
3,694,967 A 10/1972 Stielper
3,698,140 A 10/1972 Steadman
3,742,652 A 7/1973 Enders
3,753,320 A * 8/1973 Wurscher ..... 451/180
D230,045 S 1/1974 Ballone
3,818,997 A 6/1974 Bridwell
3,930,342 A 1/1976 Moores, Jr. et al.
4,001,975 A 1/1977 Bernard et al.
4,016,680 A 4/1977 Moores, Jr. et al.
4,016,685 A 4/1977 Moores, Jr. et al.
4,031,672 A 6/1977 Moores, Jr. et al.
4,176,499 A 12/1979 Mazoff
4,455,786 A 6/1984 Maysilles
4,471,581 A 9/1984 Bernard et al.
4,483,104 A 11/1984 Welliver
4,485,596 A 12/1984 Bernard et al.
4,520,599 A 6/1985 Slinsky
4,592,171 A 6/1986 Curley (Continued)

*Primary Examiner*—Timothy V Eley
(74) *Attorney, Agent, or Firm*—John P. McGonagle

(57) ABSTRACT

A drill bit dresser having a dresser body, a holding clamp slidably joined to the dresser body, and a sanding shoe pivotally attached to the dresser body. The dresser body has means for changing the rake angle of the sanding shoe to accommodate different drill types. A drill bit, leading end first, is inserted into the dresser body and held in a desired positioned by the holding clamp. The sanding shoe is pivoted to the dresser body and engages the drill bit leading end in a vertical up and down motion.

6 Claims, 13 Drawing Sheets

U.S. PATENT DOCUMENTS 4,607,463 A 8/1986 Slinsky
4,744,178 A 5/1988 Afshar
4,782,633 A 11/1988 Fuller, Jr.
4,787,176 A 11/1988 Fuller, Jr.
4,821,463 A 4/1989 Fuller, Jr.
4,850,150 A 7/1989 Bishop
4,916,867 A 4/1990 Lockwood
D309,559 S 7/1990 Vaccaro
4,974,372 A 12/1990 Chantalat
5,184,425 A 2/1993 Anderson
5,251,407 A * 10/1993 Afshar ..... 451/349
D342,007 S 12/1993 Anderson
5,400,546 A 3/1995 Christian et al.
5,676,591 A 10/1997 Huang
5,735,732 A 4/1998 Bernard
5,788,559 A 8/1998 Jungnitsch
5,938,511 A 8/1999 Patterson
5,951,385 A 9/1999 Newhouse et al.
6,001,002 A 12/1999 Lea
6,110,018 A 8/2000 Hepworth
6,116,995 A 9/2000 Chao
6,626,745 B1 9/2003 Bernard
6,676,500 B1 1/2004 Lin
6,846,231 B2 * 1/2005 Oles et al. ..... 451/415
6,878,035 B2 4/2005 Varney et al.
6,988,859 B2 1/2006 Borschert et al.
7,081,040 B2 7/2006 Varney et al.
7,147,546 B1 12/2006 Dovel
7,172,498 B2 2/2007 Bernard et al.

* cited by examiner

DRILL BIT DRESSER

CROSS-REFERENCE TO RELATED APPLICATIONS

Applicant claims the priority benefits of U.S. Provisional Patent Application No. 60/905,088, filed Mar. 6, 2007; U.S. Provisional Patent Application No. 60,961,551, filed Jul. 23, 2007; and U.S. Provisional Patent Application No. 60/966,247, filed Aug. 27, 2007.

BACKGROUND OF THE INVENTION

This invention relates to sharpening tools and, in particular, to a tool for dressing a twist drill bit.

Most high speed twist drill bits have an elongated, generally cylindrical body with two helical channels, 180 degrees apart, extending substantially the length of the drill bit. The two helical channels terminate at a pointed leading edge forming two cutting surfaces.

Eventually, after a period of use, the drill bit cutting surfaces will become dull and require sharpening. When drill bits become dull they are typically ground to resharpen them. Grinding the drill bits removes a significant amount of drill bit material thus shortening the drill bit with each grinding, and consequently the life of the drill bit.

However, when drill bits become dull, they only have to be dressed, i.e., only enough material needs to be removed to generate a sharp cutting edge. Thus, by dressing rather than grinding, the life of the drill bit may be substantially increased. Material is removed from the drill bit without compromising the geometry of the drill bit.

SUMMARY OF THE INVENTION

The present invention provides means for dressing the leading edge of the drill as well as the chisel point, the edges that do the actual cutting. While dressing these two surfaces, the chisel edges are automatically dressed at the same time. The chisel edges initiate the cutting for the main curring edges. The present invention allows an operator to insert a drill bit into a hand held device that permits the bit to be accurately aligned to an abrasive surface which, when manually moved back and forth, will remove a small portion of the first of the two cutting surfaces of the bit thus creating a sharp edge. The drill bit is then repositioned 180 degrees and the process is repeated creating a sharp edge on the second cutting surface. Although the complete surfaces of the drill bit tip are not dressed with the present invention, enough surface is dressed with a relief angle to not only create sharp cutting edges, but also enough to dress the chisel point as well.

These, together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
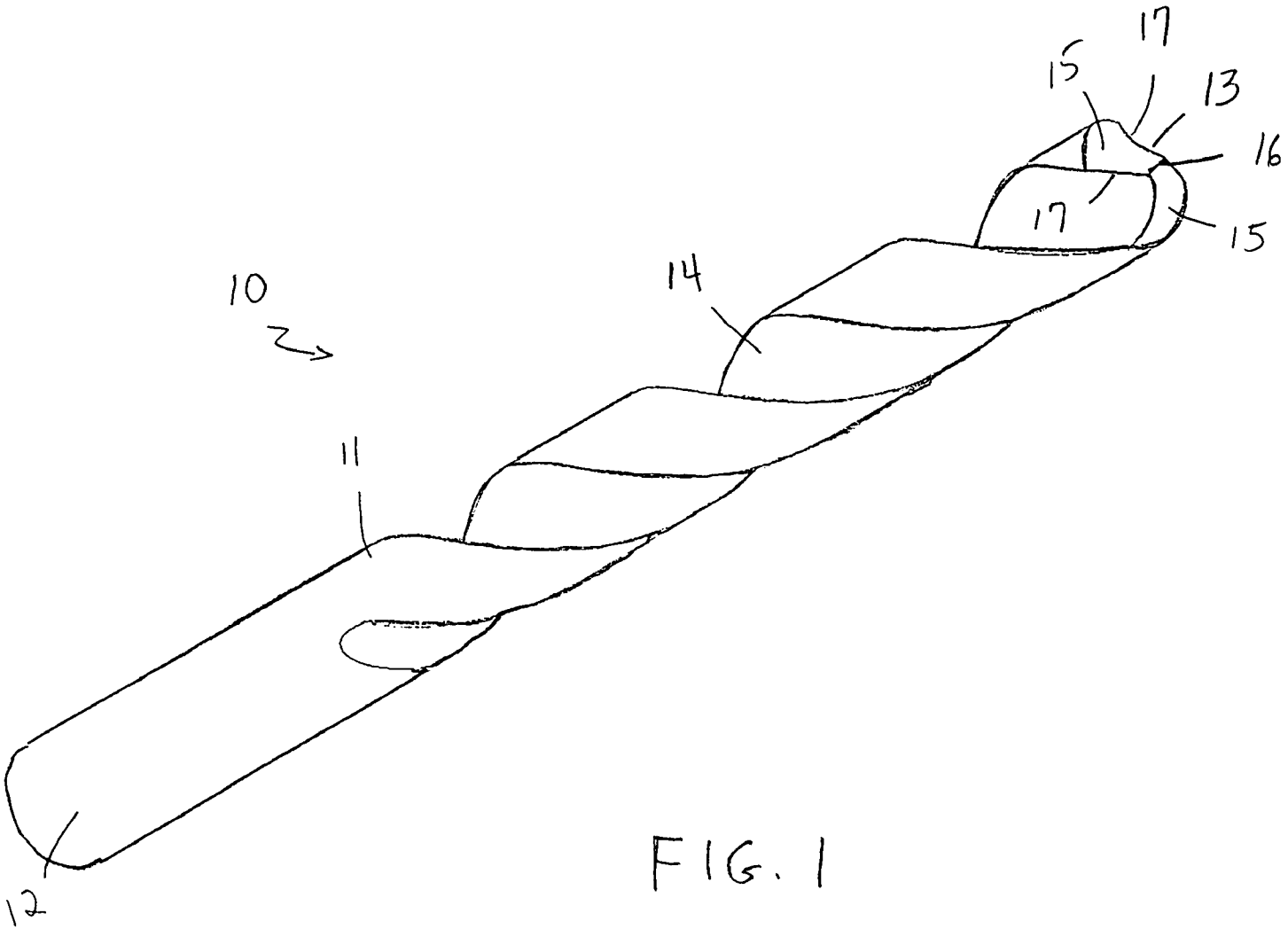
FIG. 1 is a view of a typical drill bit.
Figure 2:
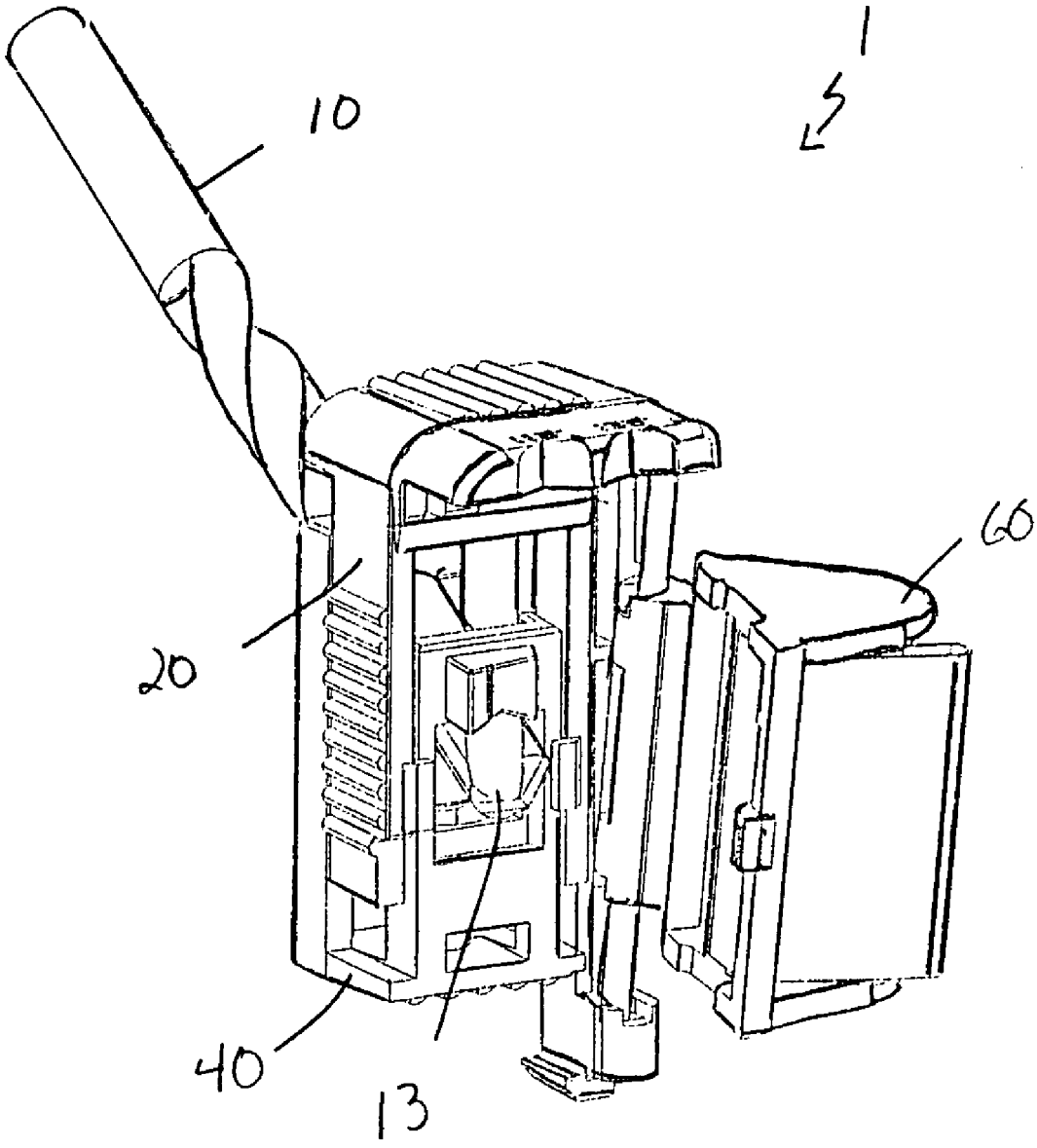
FIG. 2 is front perspective view of the invention.
Figure 3:
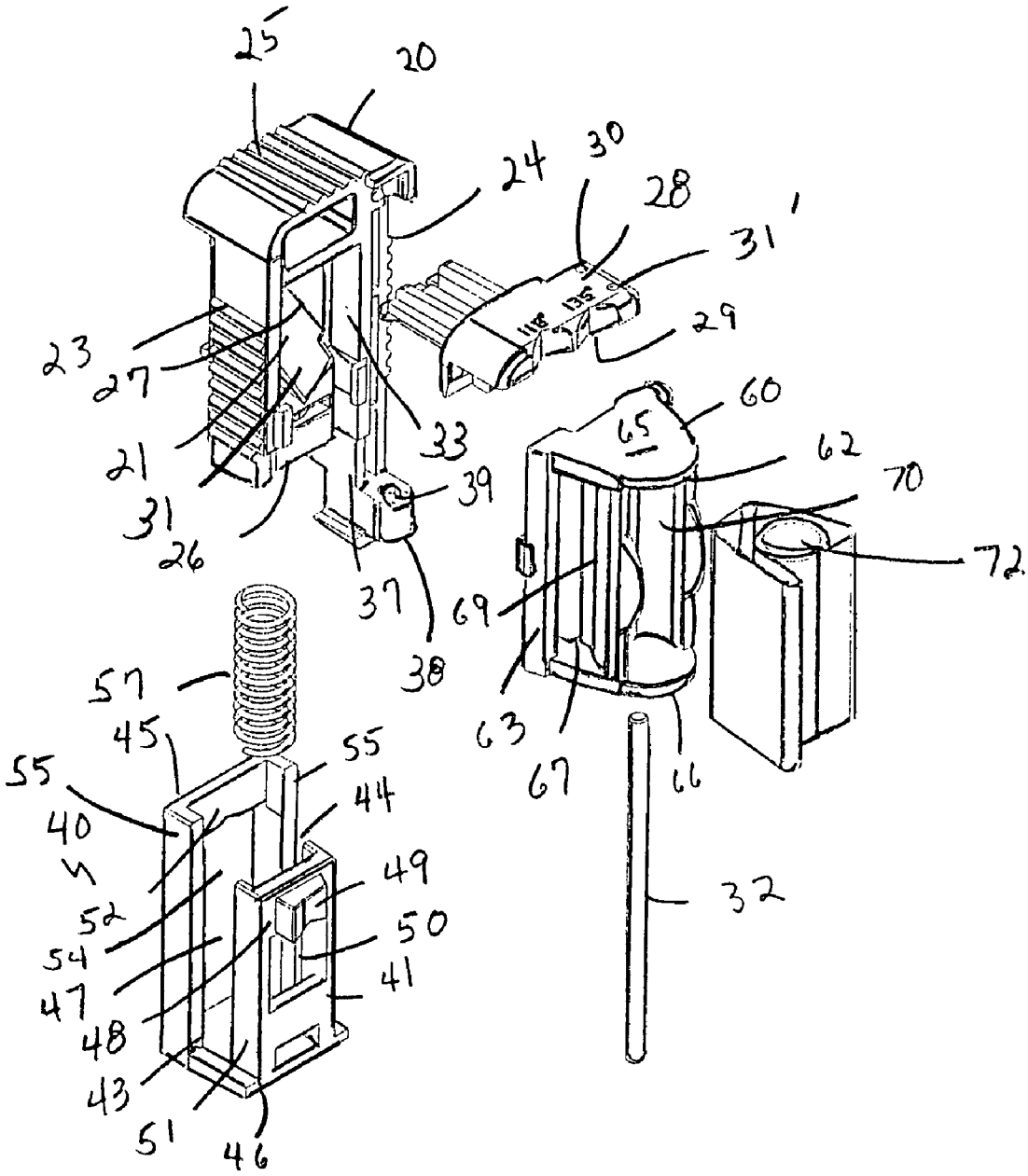
FIG. 3 is an exploded view thereof.
Figure 4:
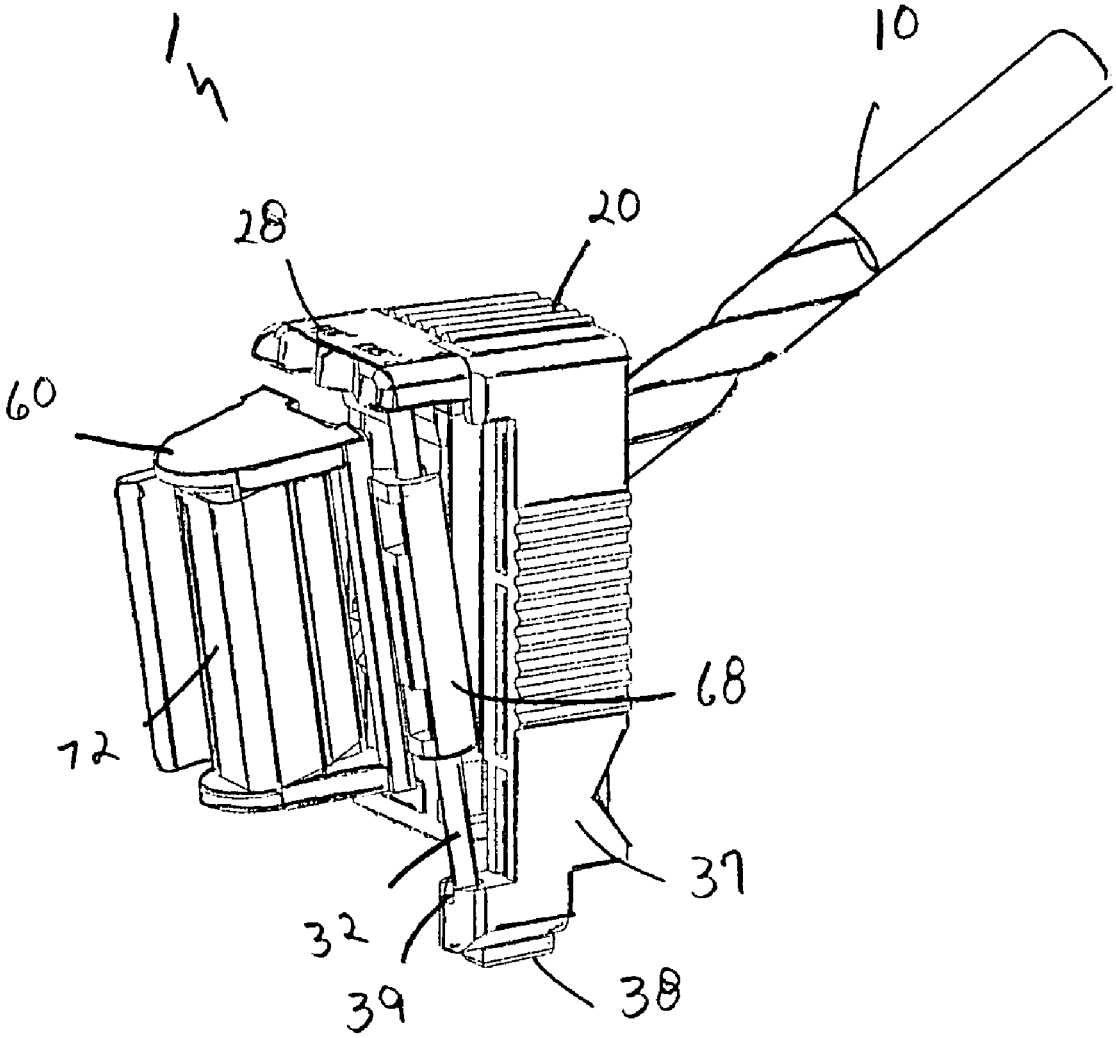
FIG. 4 is a right perspective view of the invention.
Figure 5:
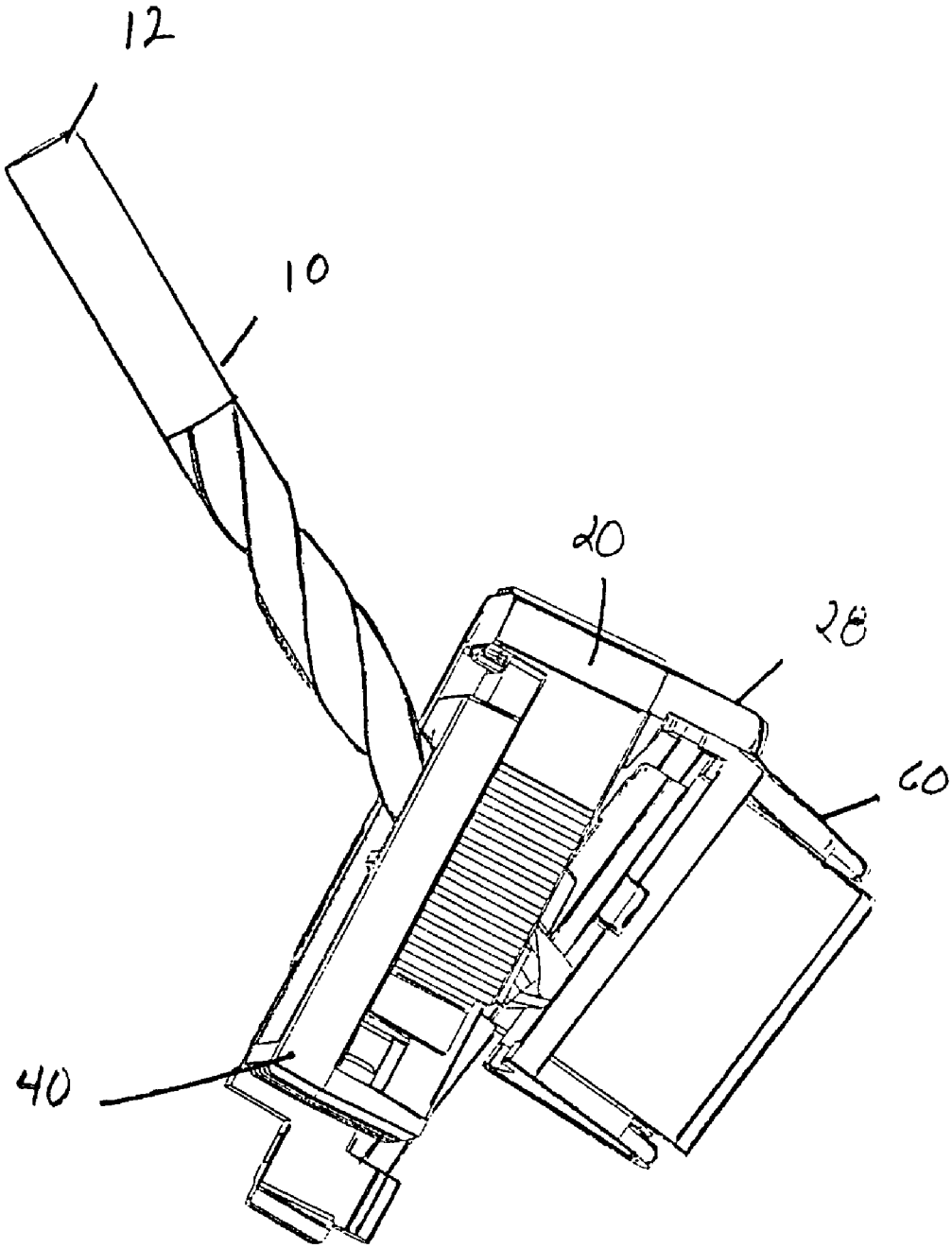
FIG. 5 is a left perspective view thereof.
Figure 6:
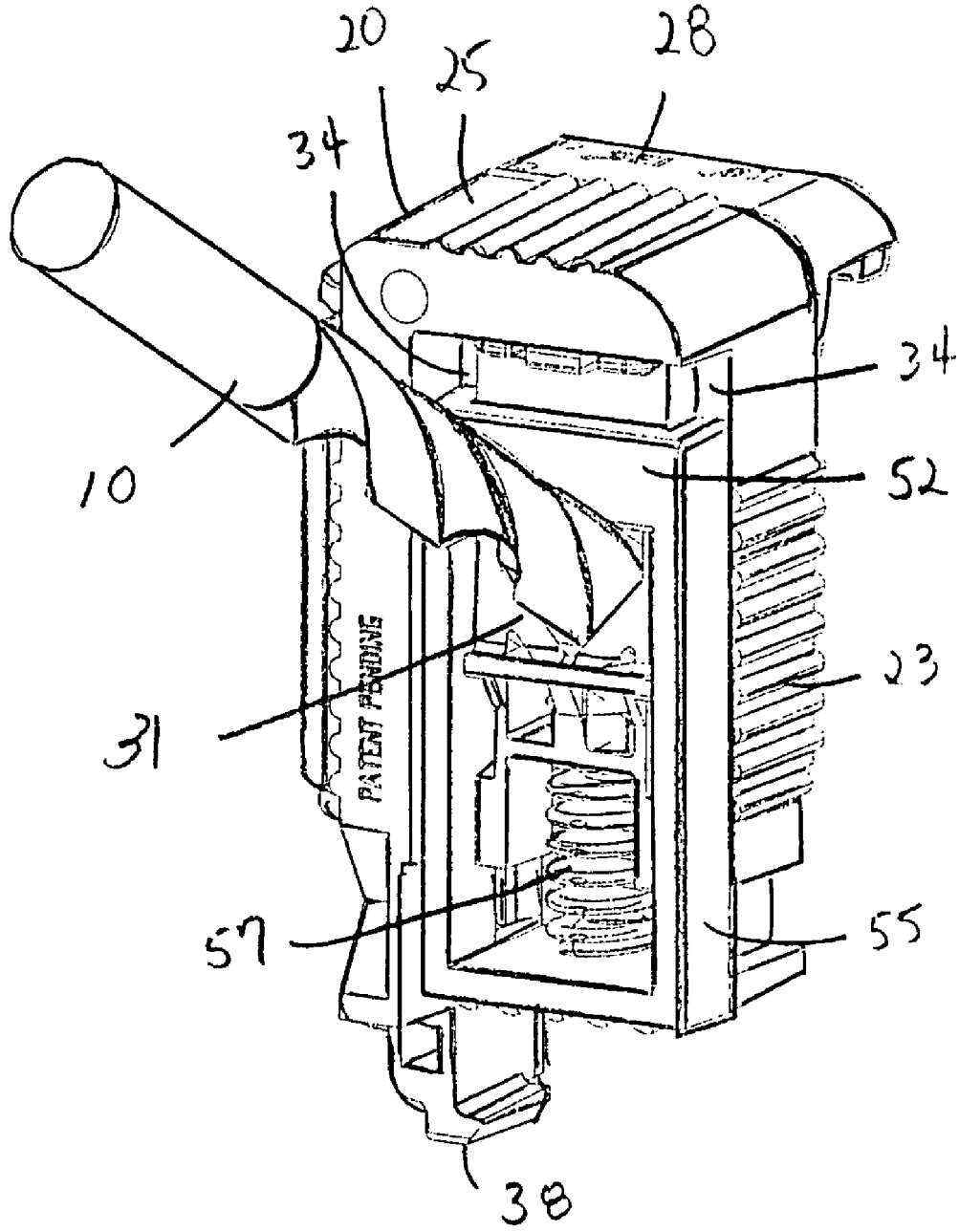
FIG. 6 is a rear perspective view thereof.
Figure 7:
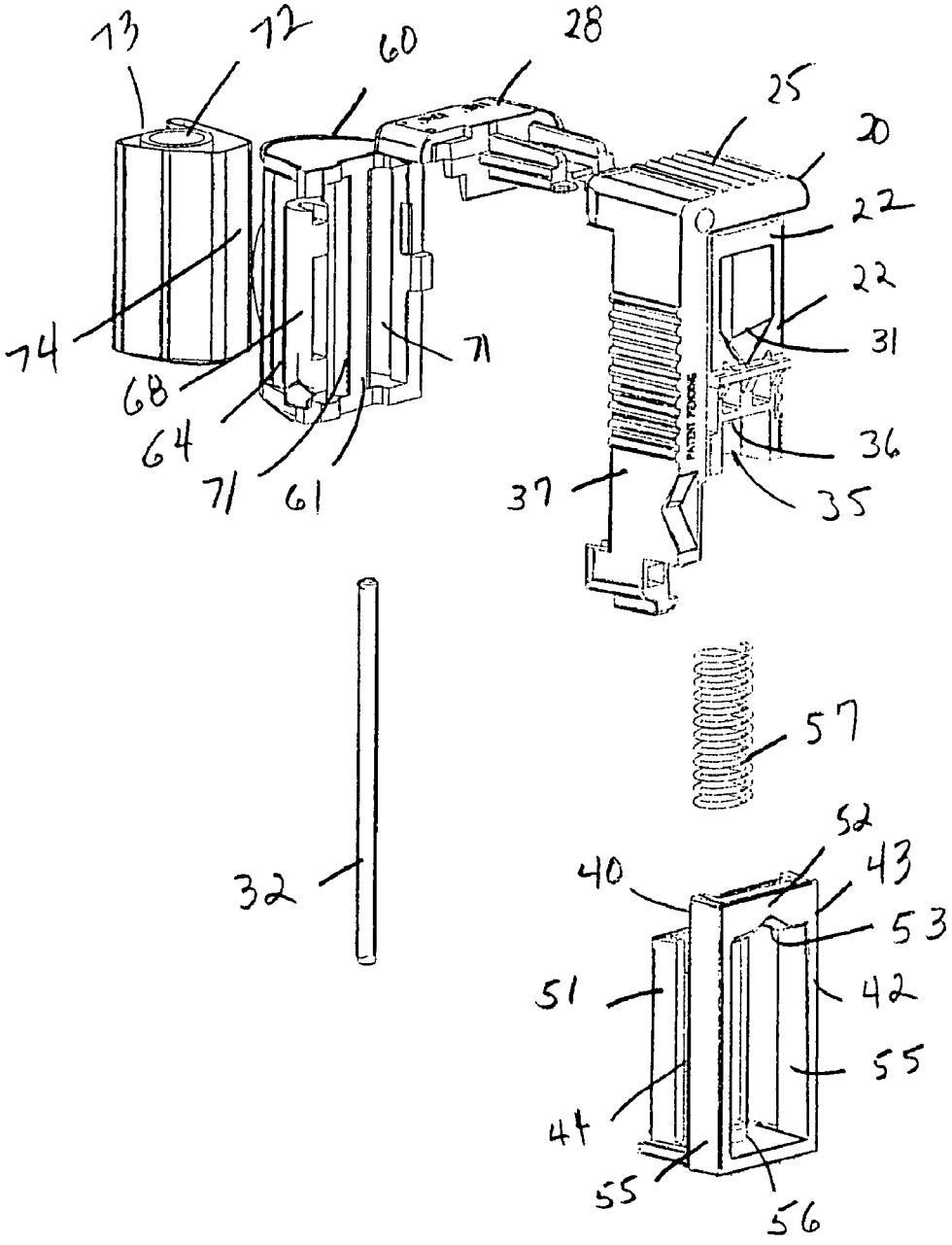
FIG. 7 is an exploded view thereof.
Figure 8:
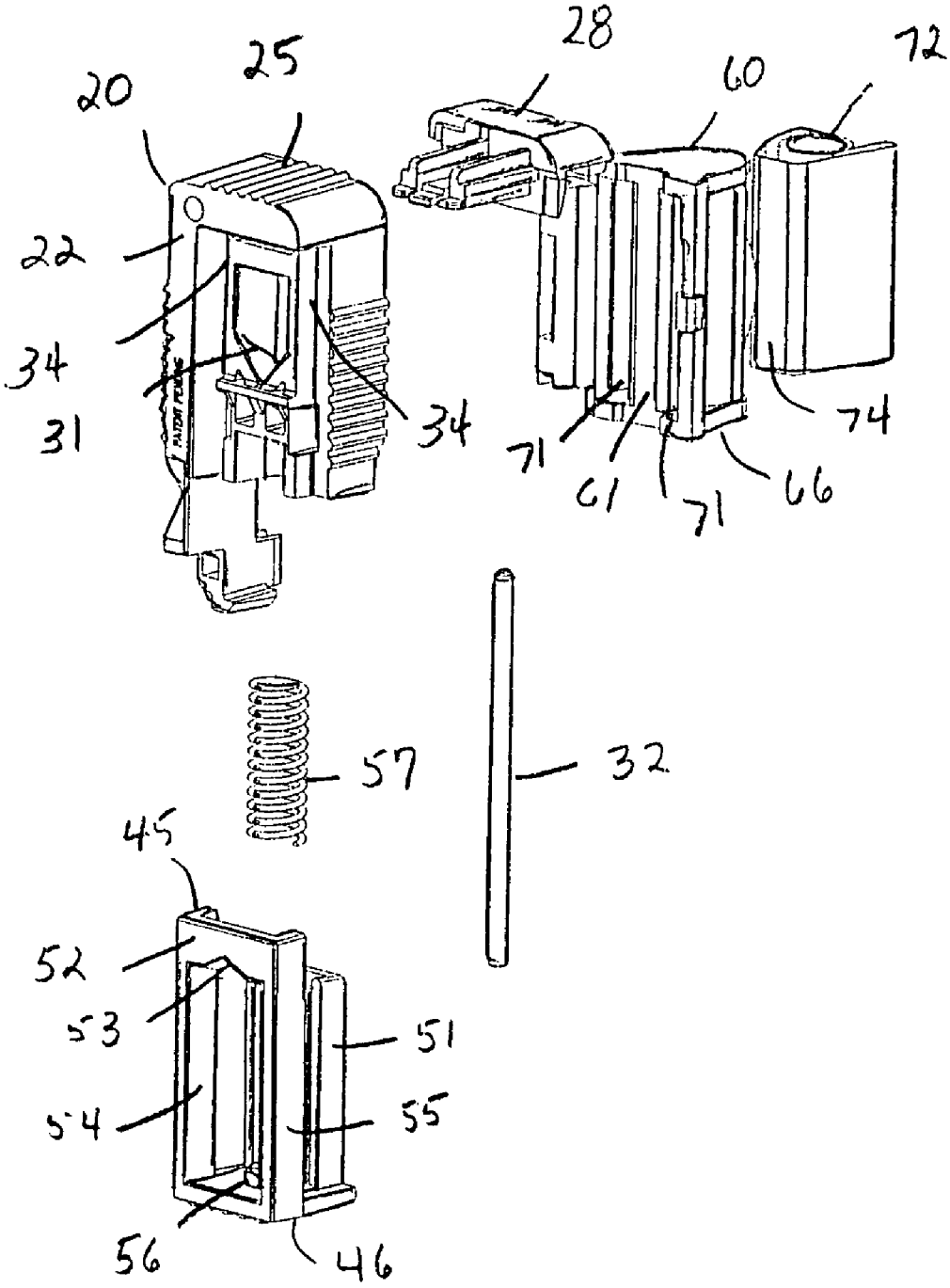
FIG. 8 is an exploded view thereof.
Figure 9:
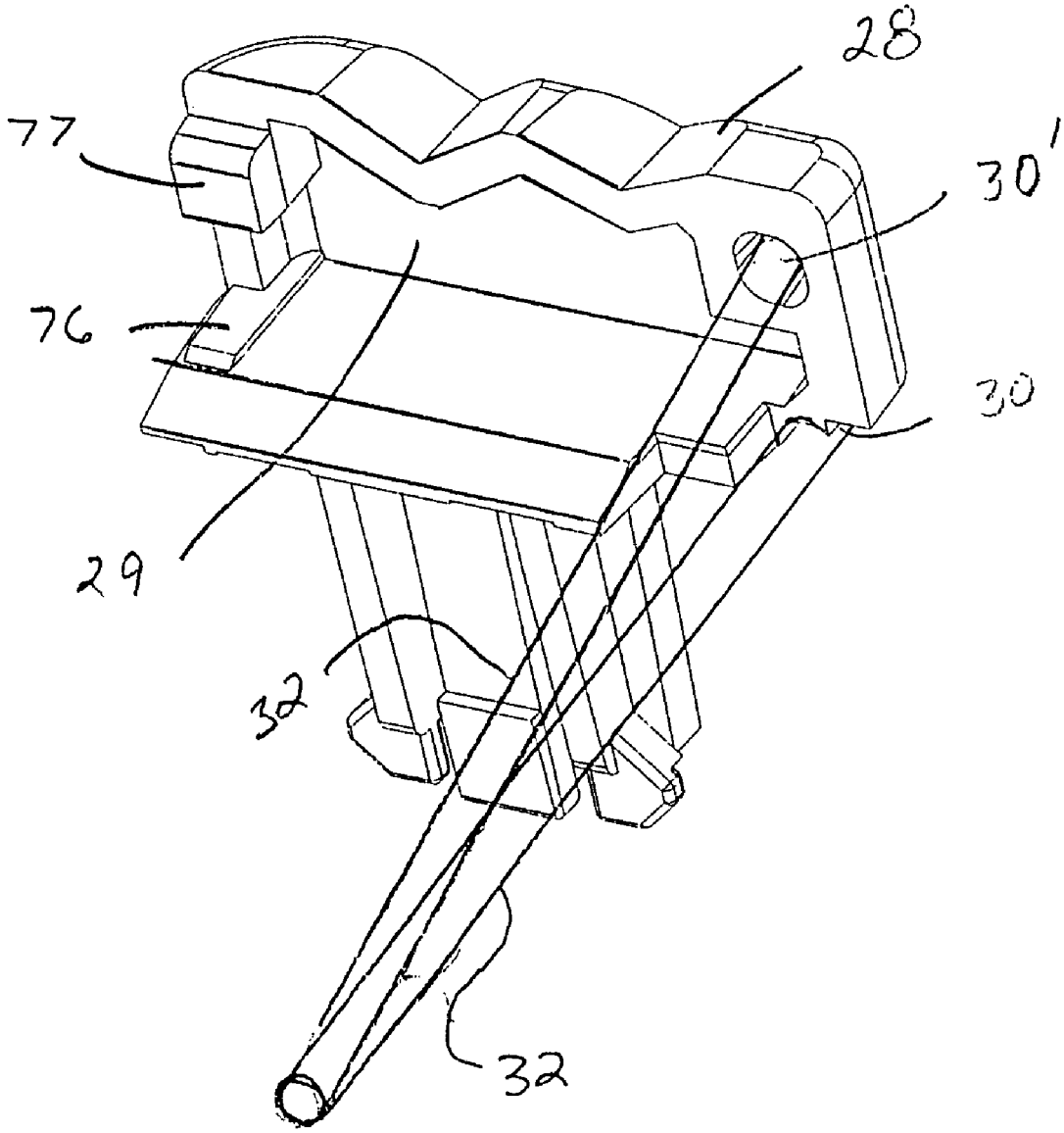
FIG. 9 is a bottom perspective view of the dresser body flange.

Referring to the drawings in detail wherein like elements are indicated by like numerals, there is shown in FIG. 1 a typical twist drill bit 10 having an elongated, generally cylindrical body 11 with a rear shank end 12, adapted to being held in a chuck, and a pointed leading end 13. The drill bit body 11 has two helical channels 14 extending substantially the length of the body and each terminating in a drill bit face 15, and angling up to a point 16 forming the drill bit leading end 13. The drill bit faces 15 provide the drill bit cutting edges 17.

In accordance with the present invention, and as illustrated in FIGS. 2 through 9, the drill bit dresser 1 includes a dresser body 20, a holding clamp 40 slidably joined to the dresser body 20, and a sanding shoe 60 pivotally attached to the dresser body 20. A drill bit 10, leading end 13 first, is inserted into the dresser body 20 and held in a desired positioned by the holding clamp 40. The sanding shoe 60 is pivoted to the dresser body 20 and engages the drill bit leading end 13 in a vertical up and down motion.

The dresser body 20 has a front 21, rear 22, left side 23, right side 24, top 25, and bottom 26, said front, rear, sides, top and bottom defining a hollow dresser body interior 27. The dresser body top 25 has a generally planar flange 28 inserted into the dresser body top 25 and extending forwardly from the dresser body front 21 and lying in a plane coincident with a dresser body top plane. The flange 28 has a bottom surface 29 with two apertures 30 formed therein. A first aperture 30 is adjacent the dresser body front 21 and right side 24. A second aperture 30' is positioned directly forward of the said first aperture 30.

The dresser body interior 27 contains a V-shaped chute 31 extending from the dresser body rear 22 downwardly to the dresser body front 21. The dresser body interior 27 also has an elongated vertical interior channel 33 formed therein on each dresser body side 23, 24 at the dresser body front 21, extending from the dresser body bottom 26 to the flange 28.

Each dresser body side 23, 24 has an elongated vertical exterior channel 34 formed at a junction of each side 23, 24 and the dresser body rear 22, each elongated vertical exterior channel 34 extending from the dresser body bottom 26 to a point below the dresser body top 25. The dresser body bottom 26 has a bottom aperture well 35 formed therein, the bottom aperture well 35 having a protrusion 36 formed therein.

The holding clamp 40 has a front wall 41, rear wall 42, left side 43, right side 44, top 45, and bottom 46, said front, rear, sides, top and bottom defining a hollow holding clamp interior 47. The holding clamp front wall 41 has a cross bar 48 adjacent the holding clamp top 45 and extending from left side 43 to right side 44. The front wall cross bar 48 has a forward element 49 attached thereto, said forward element having the shape of an inverted "V" facing downward toward the holding clamp bottom 46. The holding clamp front wall 41 has a generally rectangular aperture 50 formed centrally therein just below the cross bar 48. The holding clamp front wall 41 has two opposite side walls 51 extending rearward a desired distance toward the holding clamp rear 42. The front wall side walls 51 are adapted to fit into the dresser body interior channels 33.

The holding clamp rear wall 42 has a cross bar 52 adjacent the holding clamp top 45 and extending from left side 43 to right side 44. The rear wall cross bar 52 has an inverted "V" shaped groove 53 facing downward toward the holding clamp bottom 46. The holding clamp rear wall 42 has a generally rectangular aperture 54 formed centrally therein and extending from the rear wall cross bar 52 to the holding clamp bottom 46. The holding clamp rear wall 42 has two opposite side walls 55 extending rearward a desired distance toward the holding clamp front 41, said side walls 54 forming a portion of the holding clamp sides 43, 44. The rear wall side walls 55 are adapted to fit over the dresser body exterior channels 34.

The holding clamp interior 47 has a protrusion 56 formed on the holding clamp bottom 46. A compression spring 57 is inserted into the holding clamp interior 47 and fitted, at one end, over the holding clamp interior bottom protrusion 56. The other spring end is fitted over the dresser body, bottom aperture well protrusion 36. The action of the spring 57 is to push the holding clamp bottom 46 down and away from the dresser body bottom 26.

The dresser body right side 24 has a sanding guide pin holder 37 fixedly attached thereto and extending forward of the dresser body front 21 and extending downwardly past the dresser body bottom 26. The pin holder bottom 38 has a pin holding aperture 39 formed therein. An elongated pin 32 with two ends is inserted into the pin holding aperture 39. The other pin end is inserted into one of the flange apertures 30, 30'. The pin 32 is the means by which the sanding shoe 60 is pivotally connected to the dresser body 20. The dresser body flange 28 is removable from the dresser body 20 thereby enabling the top pin end to be inserted into one of the flange apertures 30, 30', depending on the angle desired for the sanding shoe 60 to engage the different drill bit angles. In this embodiment of the invention the angle is either 118 degrees (first flange aperture 30) or 135 degrees (second flange aperture 30').

The sanding shoe 60 has a front 61, an open rear 62, left side 63, right side 64, top 65, and bottom 66, said front, rear, sides, top and bottom defining a hollow sanding shoe interior 67. The sanding shoe front 61 is angled by the pin 32 to address the drill tip at an angle appropriate to the drill tip. The sanding shoe top 65 and bottom 66 define a sanding shoe longitudinal axis. The sanding shoe 60 has an elongated sleeve 68 formed at the junction of the sanding shoe front 61 and right side 64. The sanding shoe sleeve 68 is adapted to fit over and engage the dresser body pin 32.

The sanding shoe interior 67 contains an elongated, upright cradle 69 contained therein and extending from the sanding shoe bottom 66 to top 65. The cradle has an elongated opening 70 parallel to the sanding shoe longitudinal axis and opening toward the sanding shoe rear 62. The sanding shoe front 61 has two vertical longitudinal channels 71 opening into the sanding shoe interior 67. Each sanding shoe front channel 71 is adjacent a sanding shoe side 63, 64. A roll of sand paper 72, preferably aluminum oxide, is placed into the cradle 69. One sand paper end 73 is drawn out of the cradle opening 70 and threaded from the sanding shoe interior 67 through the front channel 71 adjacent the sanding shoe left side 63. The sand paper end 73 is then drawn across the sanding shoe front 61 and inserted through the front channel 71 adjacent the sanding shoe right side 64 into the sanding shoe interior 67. The sand paper end 73 is then drawn into the cradle opening 70.

In operation, the drill bit dresser 1 is first configured for the type of drill bit 10 to be dressed. The two most common types of twist drill bits are for wood and for metal. The cutting angle for a wood drill bit is typically 118 degrees. For a metal drill bit is typically 135 degrees. Regardless of the type of drill used, the drill is inserted the same way. The holding clamp 40 is squeezed into the dresser body 20. The drill bit 10 is then inserted, leading end 13 first, through the holding clamp rear wall aperture 54, into the dresser body rear 22 and onto the dresser body interior V-shaped chute 31, and protruding just past the holding clamp front wall cross bar forward element 49. The drill bit 10 is then turned so that a cutting edge 17 is parallel to the dresser body longitudinal axis. The holding clamp 40 is then released. The action of the spring 57 will push the holding clamp 40 downward causing the holding clamp rear wall cross bar V-groove 53 and front wall cross bar forward element 49 to firmly engage the drill bit 10.

Since the drill bit 10 is inserted into the dresser 1 the same way regardless of the leading end angle, i.e., 118 degrees or 135 degrees, the sanding shoe 60 must be adjustable to accommodate the drill leading end angle. As may be seen most clearly from FIGS. 9-13, the sanding shoe angle relative to the drill bit leading end 13 is determined by the position of the pin 32 in the flange apertures 30, 30'.

Figure 10:
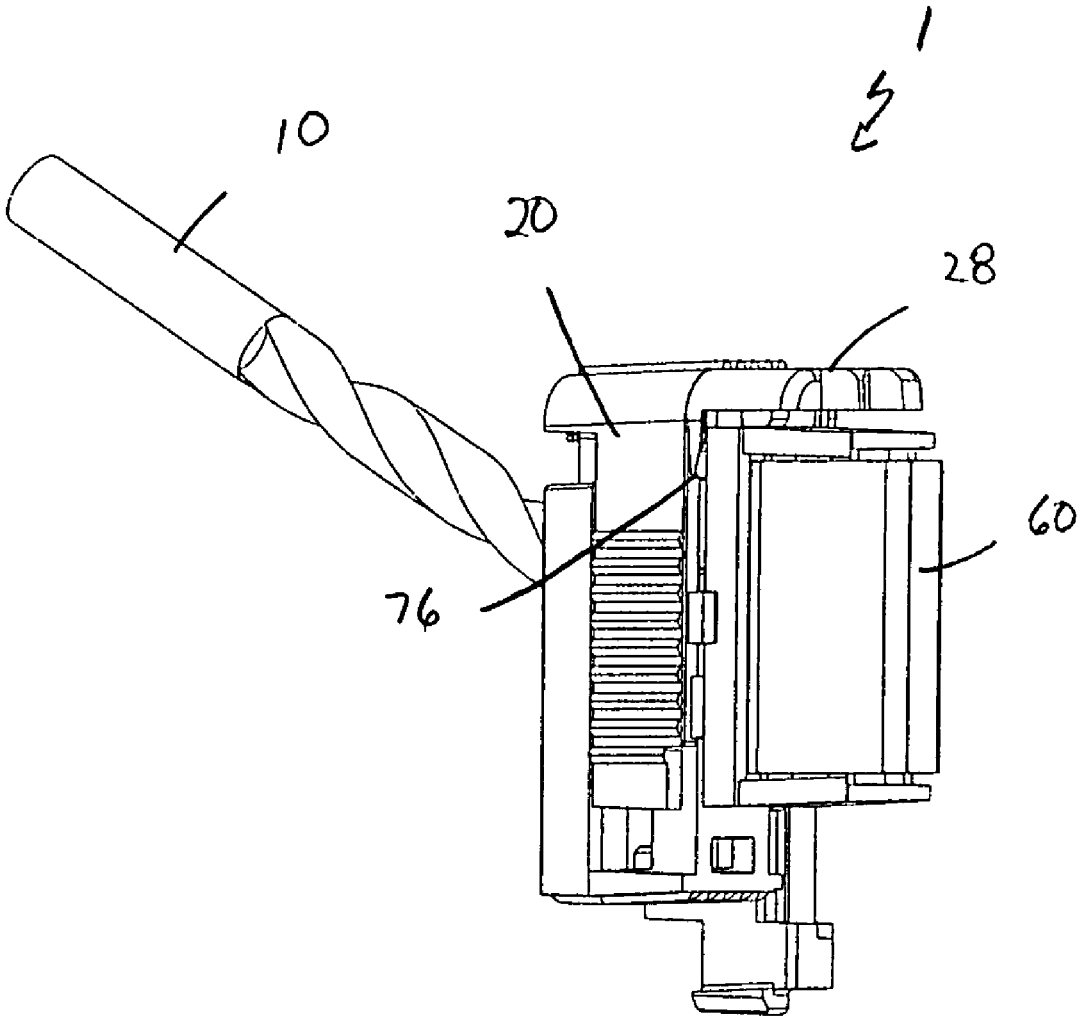
FIG. 10 is a side view of the dresser configured for a 118 degree drill leading end.
Figure 11:
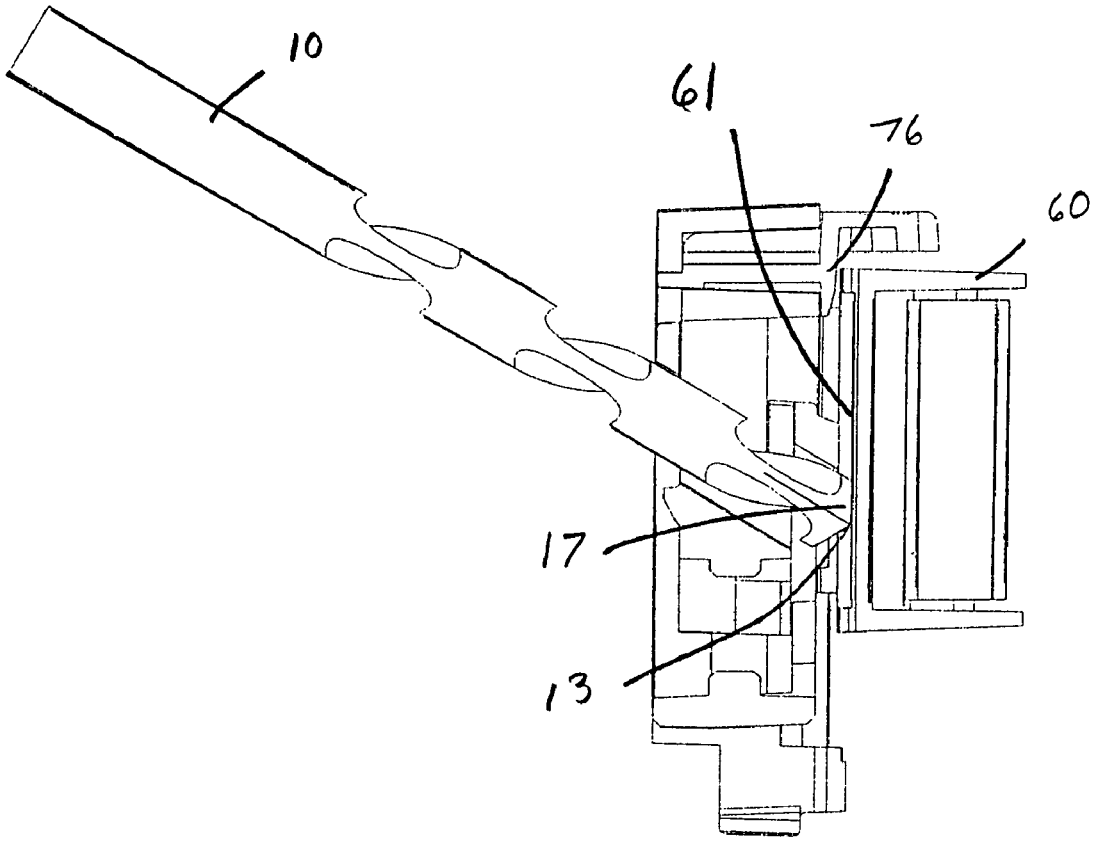
FIG. 11 is a cross sectional side view of the dresser of FIG. 10.

FIGS. 10 and 11 show the dresser 1 configured for a 118 degree drill bit leading end 13 and the pin 32 placed into the first aperture 30. The flange 28 has a first alignment element 76 for pivoting the sanding shoe 60 against, thereby positioning the sanding shoe 60 to the to the dresser body 20. A drill bit cutting edge 17 may then be advanced through the dresser body front 21 to the sanding shoe front 61. This provides proper alignment for engagement of the sanding shoe front 61 with the drill bit cutting edge 17.

Figure 12:
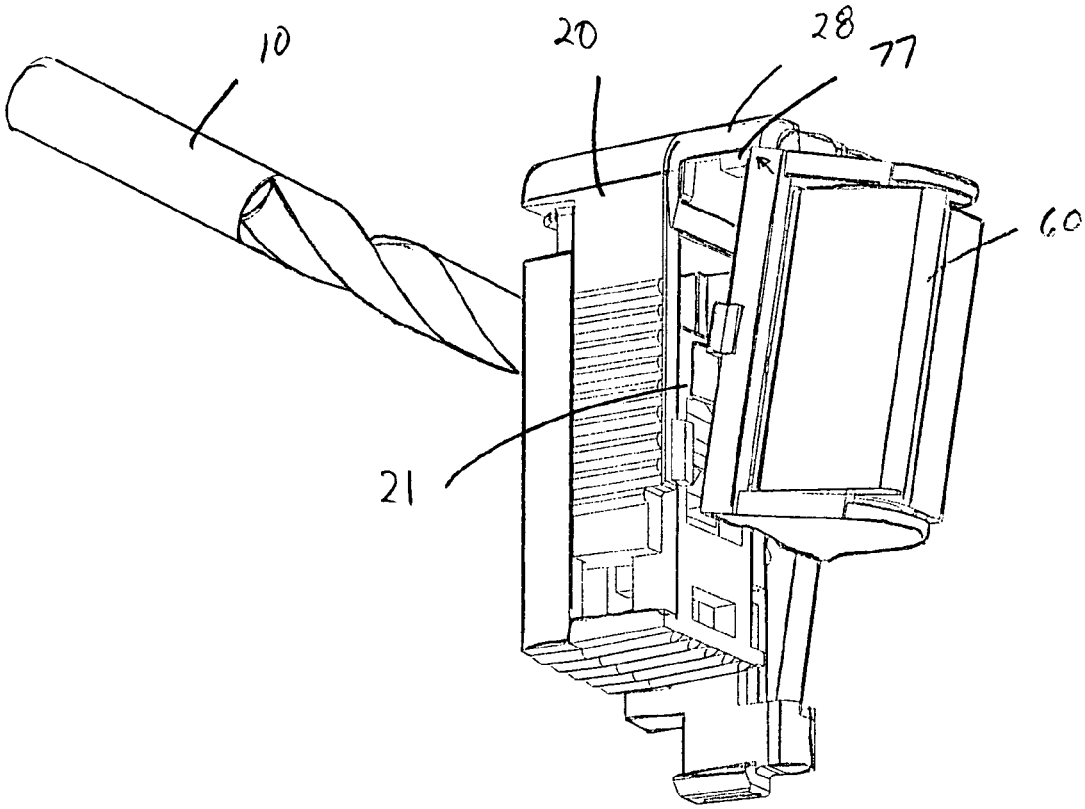
FIG. 12 is a perspective side view of the dresser configured for a 135 degree drill leading end.
Figure 13:
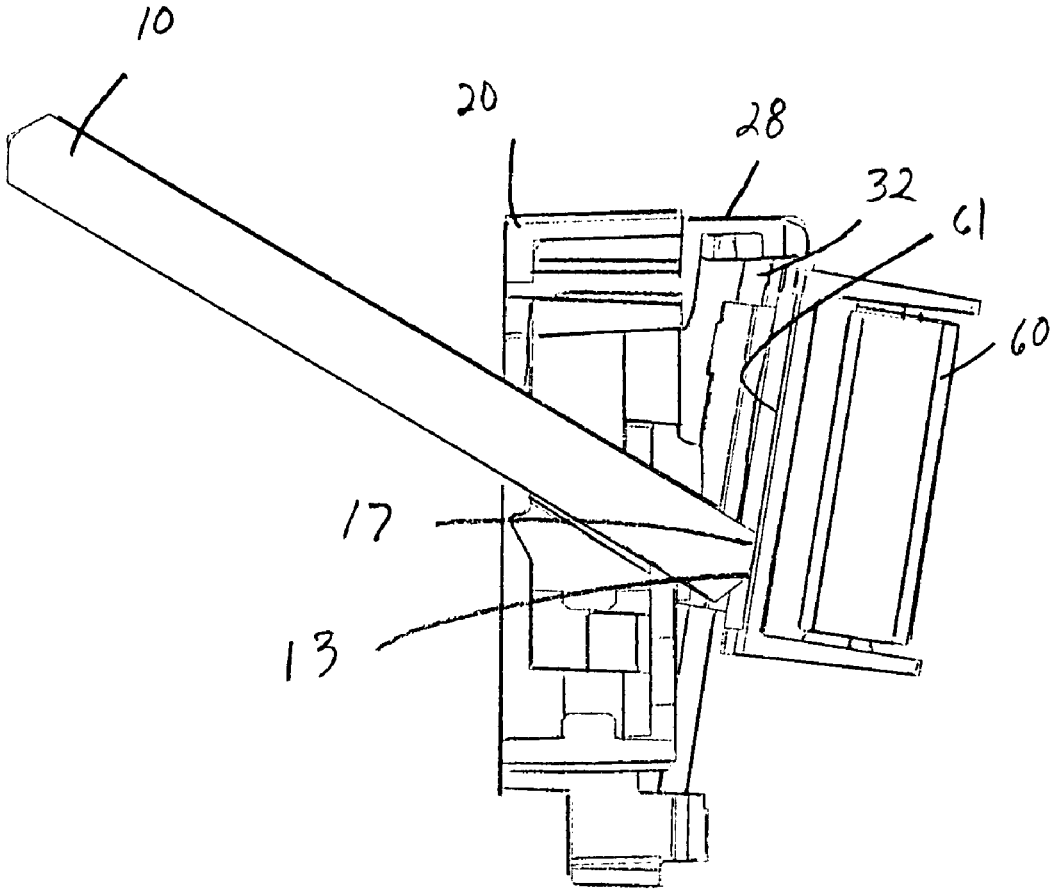
FIG. 13 is a cross sectional side view of the dresser of FIG. 12.

FIGS. 12 and 13 show the dresser 1 configured for a 135 degree drill bit leading end 13 and the pin 32 placed into the second aperture 30'. The flange 28 has a second alignment element 77 for pivoting the sanding shoe 60 against, thereby positioning the sanding shoe 60 to the to the dresser body 20. A drill bit cutting edge 17 may then be advanced through the dresser body front 21 to the sanding shoe front 61. This provides proper alignment for engagement of the sanding shoe front 61 with the drill bit cutting edge 17.

For a wood drill bit the dresser body pin 32 is inserted into the dresser body flange first aperture 30. For a metal drill bit the dresser body pin 32 is inserted into the dresser body flange second aperture 30'. The sanding shoe 60 is then pivoted about the dresser body pin 32 toward the dresser body front 21. That portion 74 of the sand paper positioned across the sanding shoe front 61 engages the drill bit cutting edge 17 at the desired rake angle. The sanding shoe 60 is adapted to be moved up and down on the dresser body pin 32, thereby having the sand paper 74 "dress" the drill bit cutting edge 17.

The sanding shoe 60 is then pivoted away from the dresser body front 21. The holding clamp 40 is then squeezed again into the dresser body 20 releasing the holding clamp's engagement with the drill bit 10. The drill bit 10 is then turned 180 degrees and the holding clamp 40 again released. The action of the spring 57 will push the holding clamp 40 downward causing the holding clamp rear wall cross bar V-groove 53 and front wall cross bar forward element 49 to firmly engage the drill bit 10. The sanding shoe 60 is then pivoted about the dresser body pin 32 toward the dresser body front 21. That portion 74 of the sand paper positioned across the sanding shoe front 61 engages the drill bit cutting edge 17.

The sanding shoe 60 is adapted to be moved up and down on the dresser body pin 32, thereby having the sand paper 74 "dress" the other drill bit cutting edge 17.

It is understood that the above-described embodiment is merely illustrative of the application. Other embodiments may be readily devised by those skilled in the art which will embody the principles of the invention and fall within the spirit and scope thereof.

I claim:

1. A drill bit dresser for a twist drill having an elongated, generally cylindrical body with a rear shank end, adapted to being held in a chuck, and a pointed leading end, said drill bit body having two helical channels extending substantially the length of the body and each terminating in a drill bit face, and angling up to a point forming the drill bit leading end, said drill bit faces providing drill bit cutting edges, comprising:

a dresser body having a front, rear, left side, right side, top, and bottom, said front, rear, sides, top and bottom defining a hollow dresser body interior, further comprising:

a generally planar flange inserted into the dresser body top and extending forwardly from the dresser body front and lying in a plane coincident with a dresser body top plane, said flange having a bottom surface with two apertures formed therein, a first aperture adjacent the dresser body front and right side and a second aperture positioned directly forward of the said first aperture;

a V-shaped chute within the dresser body interior extending from the dresser body rear downwardly to the dresser body front;

a bottom aperture well formed in the dresser body bottom, said the bottom aperture well having a protrusion formed therein and extending downwardly;

a sanding guide pin holder fixedly attached to the dresser body right side and extending forward of the dresser body front and downwardly past the dresser body bottom, said pin holder bottom having a pin holding aperture formed therein;

an elongated pin with two ends, one end inserted into the pin holding aperture and the other pin end is inserted into one of the flange apertures;

a holding clamp slidably joined to the dresser body and having a front wall, rear wall, left side, right side, top, and bottom, said front, rear, sides, top and bottom defining a hollow holding clamp interior, wherein said holding clamp front wall has a cross bar adjacent the holding clamp top and extending from left side to right side, wherein said holding clamp front wall has a generally rectangular aperture formed centrally therein below the holding clamp front wall cross bar, wherein the holding clamp rear wall has a cross bar adjacent the holding clamp top and extending from left side to right side, said rear wall cross bar having an inverted "V" shaped groove facing downward toward the holding clamp bottom, wherein the holding clamp rear wall has a generally rectangular aperture formed centrally therein and extending from the rear wall cross bar to the holding clamp bottom, wherein the holding clamp interior has a protrusion formed on the holding clamp bottom, wherein a compression spring having two ends is inserted into the holding clamp interior and fitted, at one end, over the holding clamp interior bottom protrusion, the other spring end being fitted over the dresser body, bottom aperture well protrusion; and a sanding shoe pivotally attached to the dresser body, said sanding shoe having a front, an open rear, left side, right side, top, and bottom, said front, rear, sides, top and bottom defining a hollow sanding shoe interior, wherein the sanding shoe has an elongated sleeve formed at the junction of the sanding shoe front and right side, said sanding shoe sleeve slidably fitted over and engaging the dresser body pin.

2. A drill bit dresser as recited in claim 1, wherein:

the dresser body interior has an elongated vertical interior channel formed therein on each dresser body side at the dresser body front, extending from the dresser body bottom to the flange;

wherein each dresser body side has an elongated vertical exterior channel formed at a junction of each side and the dresser body rear, each elongated vertical exterior channel extending from the dresser body bottom to a point below the dresser body top;

wherein the holding clamp front wall has two opposite side walls extending rearward a desired distance toward the holding clamp rear, said opposite side walls adapted to fit into the dresser body interior channels;

wherein the holding clamp rear wall has two opposite side walls extending rearward a desired distance toward the holding clamp front, said side walls forming a portion of the holding clamp sides, said rear wall side walls adapted to fit over the dresser body exterior channels.

3. A drill bit dresser as recited in claim 2, wherein:

the holding clamp front wall cross bar has a forward element attached thereto, said forward element having the shape of an inverted "V" facing downward toward the holding clamp bottom.

4. A drill bit dresser as recited in claim 3, wherein:

an elongated, upright cradle in said sanding shoe interior and extending from the sanding shoe bottom to top, said cradle having an elongated opening parallel to the sanding shoe longitudinal axis and opening toward the sanding shoe rear, wherein the sanding shoe front has two vertical longitudinal front channels opening into the sanding shoe interior, each said front channel being adjacent a sanding shoe side.

5. A drill bit dresser as recited in claim 4, further comprising:

a roll of sand paper in said cradle, said sand paper being drawn out of the cradle opening and threaded through the sanding shoe front channels across the sanding shoe front.

6. A drill bit dresser as recited in claim 4, wherein:

the sand paper has an aluminum oxide grit.

* * * * *